US007121911B1

(12) United States Patent
Hickman

(10) Patent No.: US 7,121,911 B1
(45) Date of Patent: Oct. 17, 2006

(54) SURFCRAFT REMOVABLE FIN SYSTEM IMPROVED PLUG INSTALLATION

(76) Inventor: Scott Noble Hickman, 1160 Maple St., Arroyo Grande, CA (US) 93420

( * ) Notice: Subject to any disclaimer, the term of this patent is extended or adjusted under 35 U.S.C. 154(b) by 0 days.

(21) Appl. No.: 11/190,342

(22) Filed: Jul. 26, 2005

(51) Int. Cl.
*B63B 1/00* (2006.01)

(52) U.S. Cl. ..... 441/79; 114/140

(58) Field of Classification Search ..... 114/39.15, 114/140; 441/74, 79
See application file for complete search history.

(56) References Cited

U.S. PATENT DOCUMENTS 4,379,703 A 4/1983 Mizell
4,804,347 A * 2/1989 Ross ..... 441/79
5,328,397 A * 7/1994 Whitty ..... 441/79
5,464,359 A 11/1995 Whitty
5,672,081 A 9/1997 Whitty
5,830,025 A * 11/1998 Fleming ..... 441/79
5,934,962 A * 8/1999 Daum et al. ..... 441/79
5,975,974 A 11/1999 McCausland
5,997,376 A * 12/1999 Block et al. ..... 441/79
6,139,383 A * 10/2000 Jolly et al. ..... 441/74
6,764,364 B1 * 7/2004 Hickman et al. ..... 441/79

* cited by examiner

*Primary Examiner*—Lars A. Olson

(57) ABSTRACT

A surfcraft fin system utilizing a rib between fin anchors. The rib sets the distance between the anchors eliminating the need for a manufacturing jig. The rib is removed during the surfcraft manufacturing process resulting in multiple fin anchors adhered into the surfcraft.

15 Claims, 5 Drawing Sheets

SURFCRAFT REMOVABLE FIN SYSTEM IMPROVED PLUG INSTALLATION

CROSS REFERENCES TO RELATED APPICATIONS

Not applicable.

FEDERALLY SPONSORED RESEARCH

Not applicable.

SEQUENCE LISTING OR PROGRAM

Not applicable.

BACKGROUND

1. Field of Invention

Surfing and surfcraft have always been very popular. Recently, traveling for surf has become increasingly popular. Travel to exotic locations with surfing gear creates new problems for surf equipment designers. Surfcraft fins are now commonly made removable to solve some of these problems. Surfcraft without removable fins are often damaged during airplane baggage handling. Because the fins protrude awkwardly from the surfcraft, they can be bumped and stressed beyond their strength resulting in damage.

Several systems exist for fastening and removing fins to and from surfcraft. During the manufacture of the surfcraft each of these systems requires routing or drilling with a hole saw. Most fin systems use a box to anchor the fin into the surfcraft. A box requires routing for installation. Two systems in particular use two or more separate plugs per fin. Plugs require drilling with a hole saw for installation. These, plugs are mounted into holes in the surfcraft. These plugs anchor the fin into the surfcaft while allowing them to be removed.

BACKGROUND

2. Discussion of Prior Art

Fin systems using a box as an anchor require routing of the surfcraft before installing the box. For example, U.S. Pat. No. 4,379,703 (1983) to Mizell requires the use of a router to achieve high volume manufacturing of surfcraft. Until the early 1990's all removable fin systems required routing of the surfcraft for fin system anchor installation.

U.S. Pat. Nos. 5,328,397 (1994), 5,464,359 (1995), 5,672,081(1997) all to Whitty, and U.S. Pat. No. 6,764,364 (2004) to Hickman et al describe a system using two or more plugs per fin. These plugs require exact spacing from each other. If the spacing is not correct the fin will not fit into the plugs. This creates a problem requiring a special spacing tool and extra labor during manufacturing. These plugs have traditionally been installed using a jig during manufacturing. The jig is used to space the plugs correctly during manufacture of the surfcraft.

In the process of manufacturing a surfcraft, removable fin systems are usually installed after a coating of fiberglass and polyester resin is applied to a shaped polyurethane foam blank. Other materials can be used for a blank such as polystyrene foam, balsa wood, or some other light shapeable material. Other materials can be used for the coating such as epoxy resin.

The removable fin system anchor is usually installed after the fiberglass coating is applied and cured. These anchors are most commonly installed before the fiberglass coating is sanded. Several fin systems use a box or plug as an anchor. The anchors are adhered into the surfcraft using a material compatible with the surfboard coating and blank. Polyester resin is one such adhesive material. These anchors sometimes include a raised skirt. This raised skirt prevents resin from flowing into the fin system anchor recess. The recess is made to accept a feature from the fin. The recess must be free of excess material. The recess is below the surface of the surfboard. Excess resin can easily flow into this recess during surfboard manufacture. The resin cures around the anchor adhering it to the surfcraft. After the resin cures the entire surfcraft is sanded. The resin connects the anchor to the surfcraft. The skirts are simply sanded away leaving a smooth surface above the fin system anchor. The skirt prevents resin from going into the recess, curing, and making the anchor unusable.

U.S. Pat. No. 5,975,974 (1999) to McCausland joins three plugs together. This allows spacing between the front and back recesses to be very accurate. This advantage is not realized because of the added weight. Also, the large perimeter, or edge between the anchor and resin coating, is prone to water leaks. One of the main advantages of plugs, the small perimeter, is eliminated in this design. Also, as the tail portion of the surfcraft flexes, this stiff box-like design changes the performance of the surfcraft.

OBJECTS AND ADVANTAGES

My invention combines multiple plugs into one piece. The plugs are spaced correctly by connecting them with a rib of plastic. When the surfcraft is sanded, the plugs become separate from each other while being permanently adhered to the surfcraft. The rib is completely sanded away separating the plugs. There are many advantages to connecting the plugs and then separating them by sanding.

- The spacing between the plugs will always be the same. There will be no spacing tool required to set the front-to-back distance between them.
- The plugs are initially one part instead of two or more.
- This multi-plug can be injection molded in one molding cycle instead of two or more. It results in a less expensive plug.
- A surfcraft manufacturer will need to order a fraction of the plugs they would have ordered.
- The surfcraft manufacturer only needs to stock a fraction of the plugs they would have stocked if the plugs were made separately.
- The advantages of separate plugs, ie., small edge perimeter and enhanced surfboard performance, are preserved.

These advantages benefit the user because the spacing is very accurate and consistent. These advantages benefit the surfcraft manufacturer because they will realize savings in both real money and manufacturing time. These advantages will benefit the plug supplier because they can manufacture multiple plugs in one molding cycle.

SUMMARY

My invention consists of a surfcraft fin system using multiple plugs per fin. These plugs anchor the fins into the surfcraft allowing them to be removed. The plugs are connected by a rib of plastic. This rib is sanded off during the manufacture of the surfboard. The plugs become two separate pieces adhered into the surfcraft after the rib is sanded away. The rib is sanded away during the normal sanding step of surfcraft manufacture. This results in exact and consistent spacing of the plugs providing benefits to the user, the surfcraft manufacturer, and the plug manufacturer.

DRAWINGS

Drawing Figures

Figure 4:
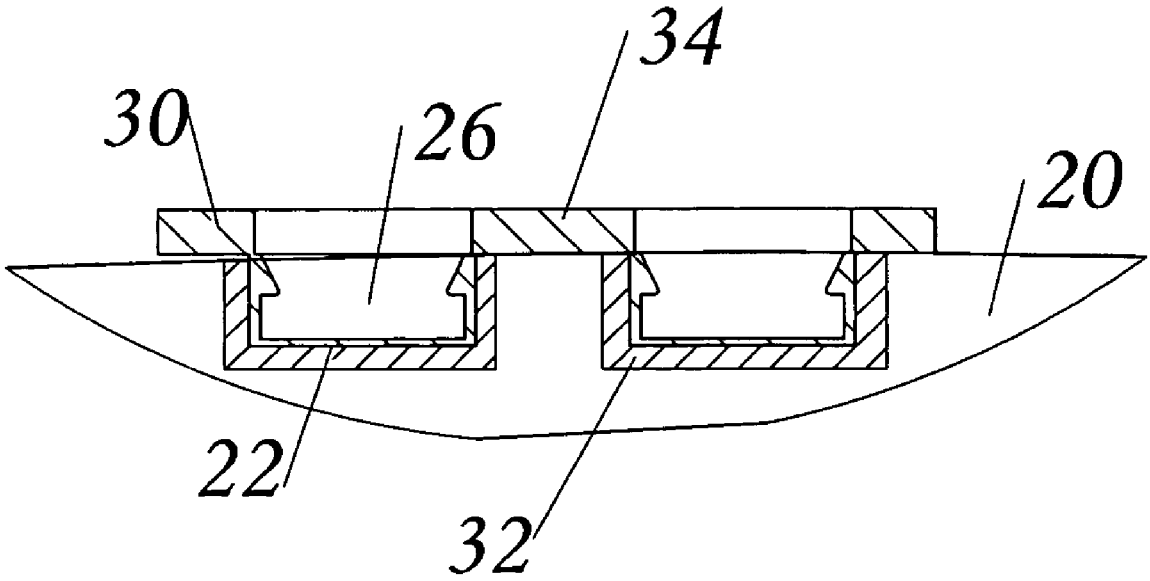

FIG. 4 is a cross sectional view of a surfcraft and plugs. The skirts are shown before sanding. A rib connects the plugs.

Figure 5:
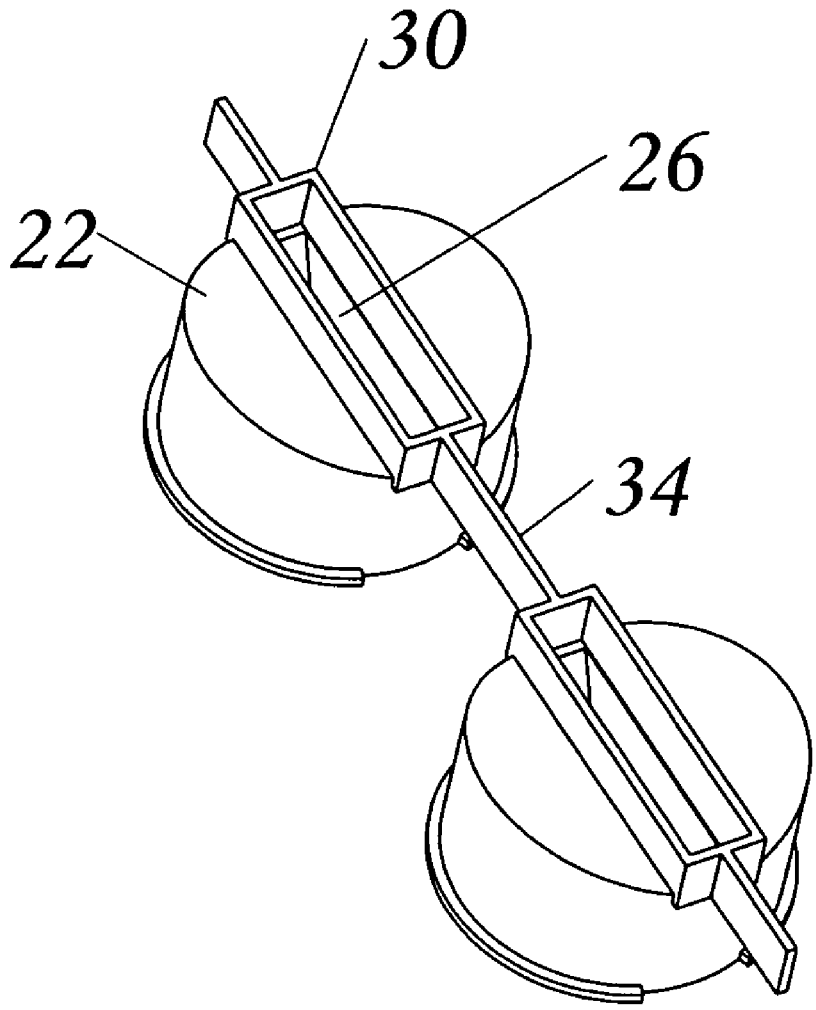

FIG. 5 is an isometric view of two plugs with skirts connected with a rib.

Reference Numerals in Drawings

20—surfcraft
22—plug
24—fin
26—recess
28—tab
30—skirt
32—resin
34—rib

DETAILED DESCRIPTION

Description—FIGS. 1–5—Preferred Embodiment

A preferred embodiment my fin system is illustrated in FIGS. 1 through 5.

Figure 1:
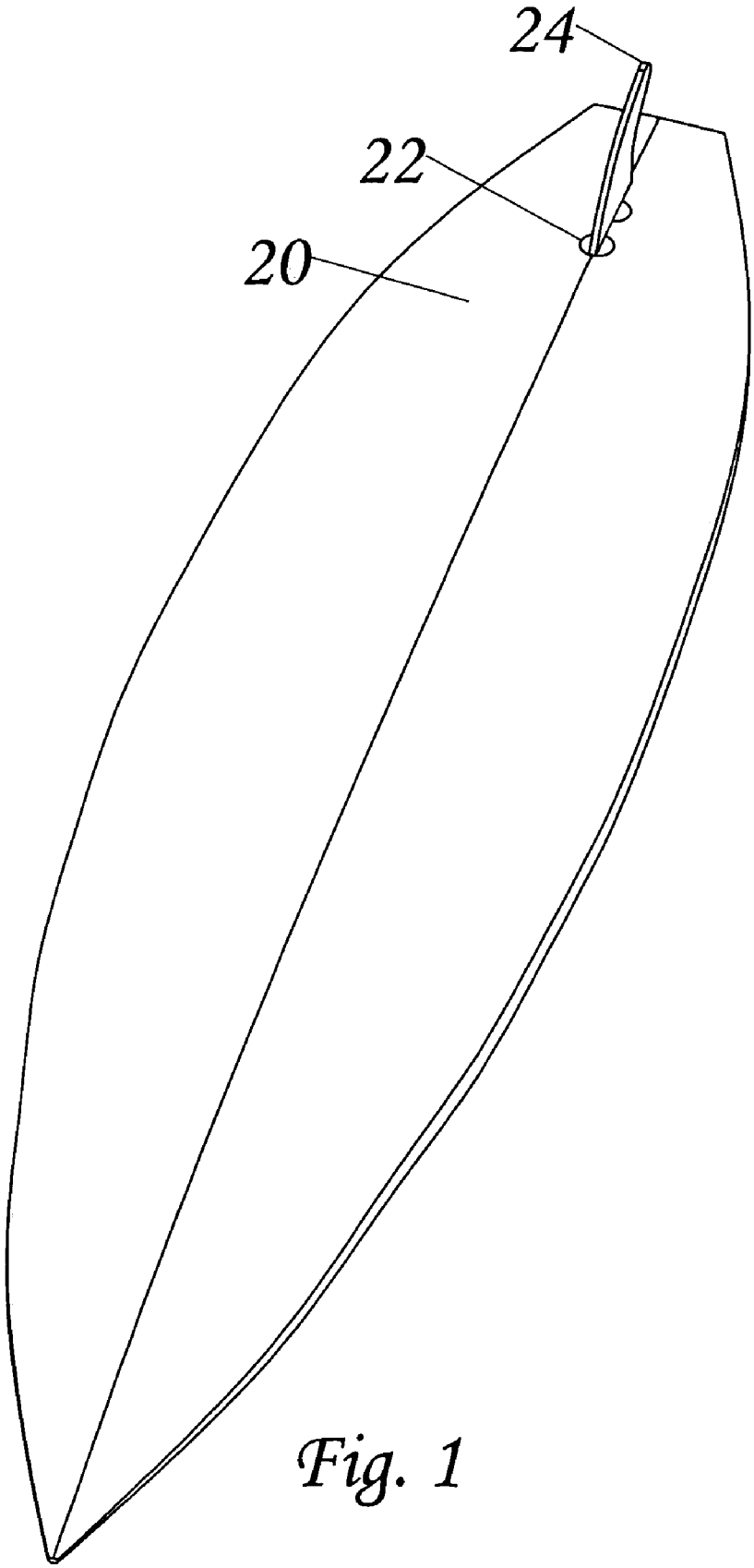
FIG. 1 is an overall view of a surfcraft utilizing a plug fin system.

FIG. 1 is an overall view of a fin 24 in a surfcraft 20 anchored with two separate plugs 22. The surfcraft has been sanded and is in the condition that a user will employ.

Figure 2:
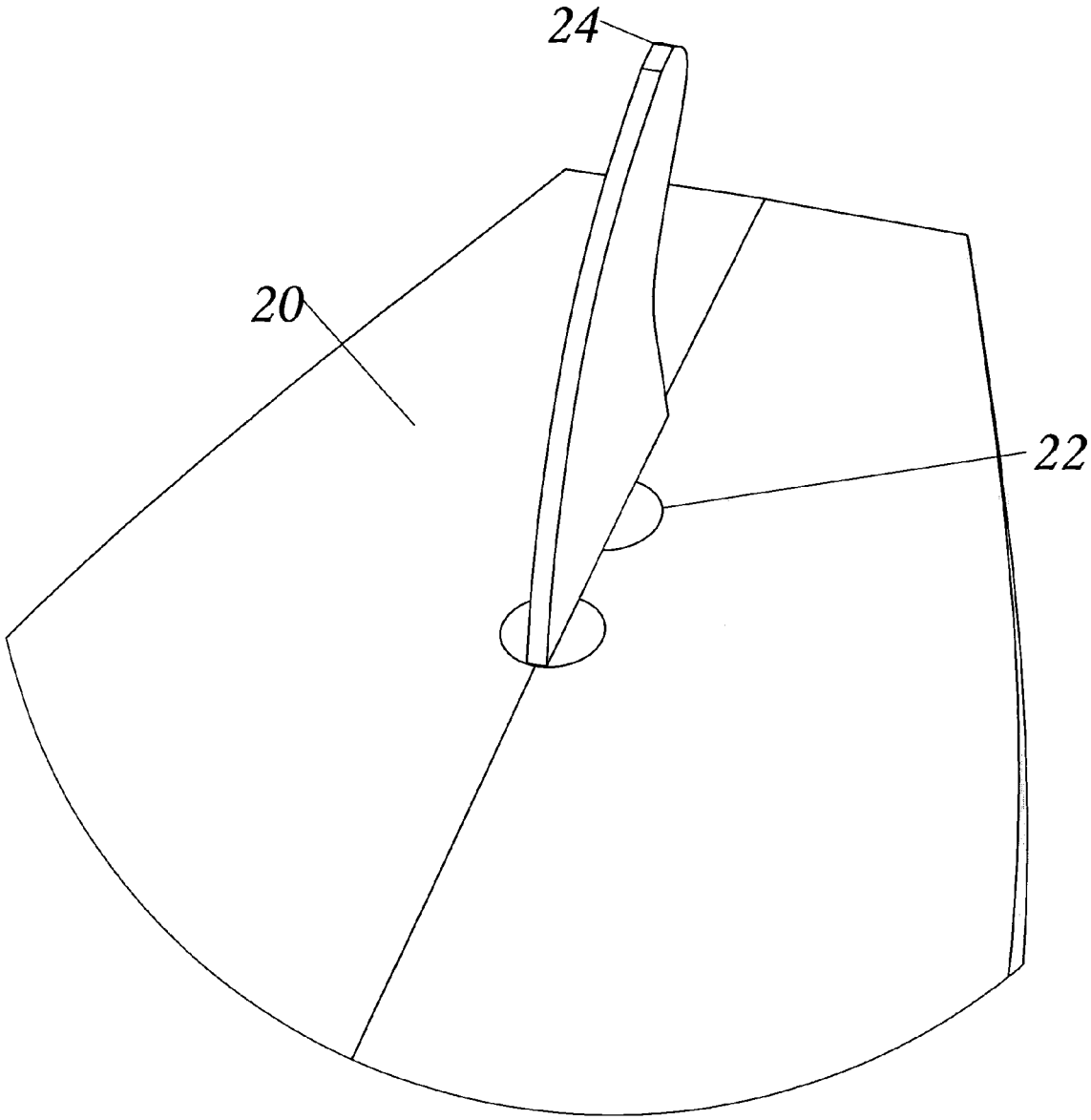
FIG. 2 is a closer isometric view showing the fin and plugs in a surfcraft.

FIG. 2 is a detail view of FIG. 1. The surfcraft 20 has been sanded. It is in the condition that a user will employ.

Figure 3:
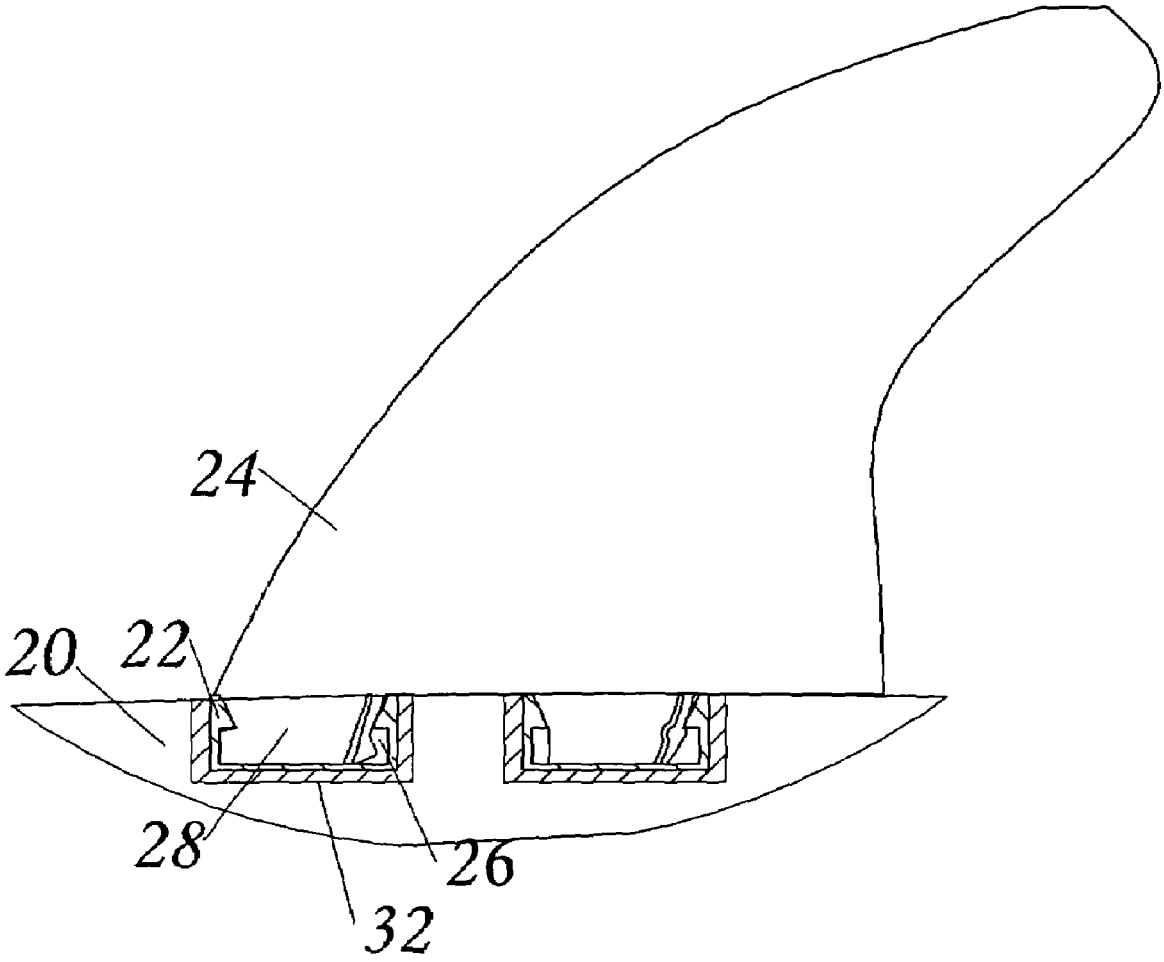
FIG. 3 is a cross section of a single fin, plugs, and surfcraft.

FIG. 3 is a section view of the fin system of FIG. 2 showing the surfcraft 20. Plugs 22 are shown adhered with resin 32. A fin 24 is installed in the plugs. Fin tabs 28 are inserted into plug recesses 26. The surfcraft has been sanded and is in the condition that a user will employ.

FIG. 4 is the same section view as FIG. 3. The fin is not shown and the plugs 22 have not been sanded. The skirt 30 has not been sanded away. The plugs are connected by a rib 34. The plugs have recesses 26. The plugs are adhered to the surfcraft by resin 32.

FIG. 5 is an isometric view of two plugs 22 with skirts 30 connected with a rib 34. The plugs have recesses 26.

Operation of Preferred Embodiment—FIGS. 1–5

During manufacture of a surfcraft, holes are cut into the surfcraft with a hole saw. Resin is poured into the holes. Plugs are placed into the holes and into the resin. A jig is used to set the fin angle, but the front to back distance between the plugs is fixed by a rib connecting the plug skirts.

After the resin is allowed to cure, the entire surfcraft is sanded, including the plug skirts and rib. After sanding the plugs have become separated because the skirt and rib are sanded away. The separated plugs are adhered into the surfcraft by resin.

After sanding, a fin is inserted into the plugs. The surfcraft including fins is ready for use.

While my above description contains many specificities, these should not be construed as limitations on the scope of my invention, but rather as an exemplification of one preferred embodiment thereof. Many other variations are possible. For example, more than two plugs may be used. The plug shape may not be circular but oval, square, rectangular, or some other shape. The rib may not be connected directly to a skirt, but some other part of the plug. The rib must be located so as to be sanded away from the plugs enough to allow a hydrodynamic surface between the plugs.

Accordingly, the scope of the invention should be determined not by the embodiments illustrated, but by the appended claims and their equivalents.

The invention claimed is:

1. A surfcraft fin system comprising:
(a) a surfcraft
(b) a fin
(c) at least two plugs
(d) an adhesive to secure the plugs into the surfcraft
(e) a means of anchoring the fin into the plugs
(f) a rib
whereby the rib sets the distance between the plugs and is sanded away resulting in multiple separated plugs adhered into the surfcraft.

2. The surfcraft fin system of claim 1 wherein the plug includes a skirt.

3. The surfcraft fin system of claim 2 wherein the rib attaches to the skirt.

4. The surfcraft fin system of claim 1 wherein the adhesive is polyester resin.

5. The surfcraft fin system of claim 1 wherein the means of anchoring the fin into the plugs uses a tab on the fin inserted into a recess in the plug.

6. A surfcraft fin system comprising:
(a) a surfcraft
(b) a fin
(c) multiple anchors
(d) a means of securing the anchors into the surfcraft
(e) a means of securing the fin into the anchors
(f) a means of connecting the anchors such that they are one piece whereby the anchors are set in the correct position by virtue of their construction, but after manufacture of the surfcraft the means of connecting the anchors such that they are one piece has been removed so that the anchors are discrete and secured into the surfcraft.

7. The surfcraft fin system of claim 6 wherein the means of connecting the anchors is sanded away before the surfcraft is used.

8. The surfcraft fin system of claim 7 wherein the means to secure the anchors into the surfcraft is polyester resin.

9. The surfcraft of claim 8 wherein the means to secure the fin into the anchors uses a tab on the fin inserted into a recess in the plug.

10. The surfcraft fin system of claim 9 wherein the means of connecting the anchors is by a rib.

11. The surfcraft fin system of claim 10 wherein the anchors are plugs.

12. The surfcraft fin system of claim 6 wherein the anchors are plugs.

13. The surfcraft fin system of claim 6 wherein the means to secure the anchors incorporates polyester resin.

14. The surfcraft fin system of claim 9 wherein the means of connecting the anchors is a rib.

15. A surfcraft fin system comprising:

(a) a surfcraft (b) a fin (c) a fin anchor (d) a means of securing the fin anchor to the surfcraft (e) a means of securing the fin to the fin anchor whereby after sanding of the surfcraft the anchor becomes separated into multiple anchors.

* * * * *